United States Patent [19]

Dochnahl

[11] Patent Number: 4,733,436

[45] Date of Patent: Mar. 29, 1988

[54] DOOR MECHANISM SPRING ASSEMBLY

[75] Inventor: Gaylord C. Dochnahl, Upland, Calif.

[73] Assignee: Exemplar, Inc., Ontario, Calif.

[21] Appl. No.: 40,370

[22] Filed: Apr. 16, 1987

Related U.S. Application Data

[63] Continuation-in-part of Ser. No. 744,953, Jun. 17, 1985.

[51] Int. Cl.[4] ..... E05F 1/04

[52] U.S. Cl. ..... 16/306; 16/DIG. 9; 16/DIG. 10

[58] Field of Search ..... 16/287, 289, 295, 298, 16/302, 306, DIG. 9, DIG. 10; 49/332, 347

[56] References Cited

U.S. PATENT DOCUMENTS

| | | | |
|---|---|---|---|
| 819,092 | 5/1906 | Smith . | |
| 2,090,146 | 8/1937 | Pixley | 16/289 |
| 2,189,233 | 2/1940 | Vanderveld . | |
| 2,420,276 | 5/1947 | Wood . | |
| 2,450,593 | 10/1949 | Homes . | |
| 2,523,207 | 9/1950 | Fowler et al. . | |
| 2,616,716 | 11/1952 | Annis . | |
| 2,646,589 | 7/1953 | Quinn . | |
| 2,684,846 | 7/1954 | Beall | 49/347 |
| 2,694,318 | 11/1954 | Smith et al. . | |
| 3,112,103 | 11/1963 | Falkenberg . | |
| 3,464,161 | 9/1969 | Jonsson et al. . | |
| 3,568,365 | 3/1971 | Pernberton et al. . | |
| 3,680,259 | 8/1972 | Andresen . | |
| 4,048,695 | 9/1977 | Juilfs et al. . | |
| 4,178,655 | 12/1979 | Little . | |

OTHER PUBLICATIONS

Installation Instructions—Stanley Series 200 Garage Door, pp. 10, 11, Stanley Work, Troy, Mich., no publication date.

Installation Instructions—Exemplar Model 120, 240, 360, 480 (1 sheet) Exemplar, Inc., Ontario, Calif., no publication date.

*Primary Examiner*—M. Jordan

*Attorney, Agent, or Firm*—Sheldon & Mak

[57] ABSTRACT

A spring assembly for counterbalancing a door includes a compression spring and tension members engaging opposite ends of the spring. The tension members can be connected in a conventional horizontally pivoted door mechanism or a track-guided door mechanism, the assembly replacing ordinary tension springs of the pivoted mechanism. The tension members and the spring are maintained in axial alignment during compression of the spring, which can be preloaded as desired. Provision is made for an initial preload corresponding to a lowered position of the door, facilitating installation and adjustment of the spring assembly. The assembly is fail-safe in that the spring is completely enclosed and the spring, if broken, continues to provide support for the door. In the track-guided mechanism, the spring assembly is connected between an anchor and a driveshaft pulley by a cable that is wound onto the pulley. A torque that is produced in the driveshaft by the spring assembly is coupled to a lift pulley on the shaft, the lift pulley being connected to the door by a second cable for applying a counterbalancing force to the door. The power pulley and the lift pulley are of different diameters for matching the load capacity and stroke of the spring to the weight and travel of the door.

22 Claims, 6 Drawing Figures

DOOR MECHANISM SPRING ASSEMBLY

This application is a continuation-in-part of copending application Ser. No. 744,953, filed June 17, 1985, which is incorporated herein by this reference.

BACKGROUND

This invention relates to door mechanisms, and more particularly to counterbalancing springs for heavy doors, ramps, gates or large structures such as garages and other buildings.

Many car garages, especially those in residential buildings, are equipped with doors that are opened by raising them from a vertical closed position to a horizontal open position. The doors, which are quite heavy, must be counterbalanced to permit reasonably easy opening and closing. The doors typically are of two types, pivoted doors, and track-guided doors.

The pivoted garage doors of the prior art, whether directly pivoted on a horizontal axis or indirectly pivoted by a multiple bar linkage mechanism, are usually counterbalanced by long, helical, closely wound tension springs.

There are several disadvantages with the conventional tension springs of the prior art. Tension springs are not very durable. They break after a certain amount of use as a result of overloading and/or metal fatigue. The breakage occurs usually while the spring is extended from the relatively relaxed open position as the door is closed. The danger of spring breakage is aggravated by the presence of adjustment devices in most prior art door mechanisms. In an effort to increase the counterbalancing force, the spring can be adjusted to a greater extension than it can safely stand, becoming overloaded when the door is closed. When breakage occurs, pieces and small metal fragments from the broken spring can fly through air, posing a serious danger to both life and property. The end portions of the broken spring can whip around, presenting additional dangers. Also, if the spring breaks while the door is being lifted or lowered, the loss of the counterbalancing tension provided by the spring can cause the door to come crashing down, again posing grave health hazards to a person operating the door.

Moreover, most of these garage door spring assemblies use helical tension springs with unsightly exposed coils. The coils separate when the spring is extended. There is always the danger that objects or fingers can be caught between the coils when tension is relaxed, causing damage or physical injury.

The track-guided doors of the prior art, whether of one-piece or folding construction, are usually connected on opposite sides by cables to respective lift drums of a transverse, rotatably mounted, overhead drive-shaft. Counterbalancing is typically provided by one or more elongated helical torsion springs that encircle the drive shaft. These doors have many of the above-described disadvantages of the pivoted doors. A further disadvantage is that the adjustment of the mechanism is specially awkward and dangerous because of its overhead location. Indeed, it is often required that the installation and adjustment of the overhead torsion springs be performed by specially licensed installers because they are so dangerous. Moreover, access to the drive shaft is typically blocked from below when the door is opened, and the mechanism has to be adjusted in the fully preloaded, closed position wherein there is the dangerous condition of maximum spring loading. Climbing above the open door is even more dangerous.

A further problem that is typical of both the pivoted and track-guided doors is that the installation and adjustment of counterbalancing springs is difficult and dangerous because high spring loading is present, especially when the door is closed. Often the door is propped open by makeshift means, subjecting a worker to a danger of the door crashing down during spring installation.

Thus there is a need for a door counterbalancing spring that is safe and reliable, inexpensive to make and install, neat in appearance, and capable of replacing conventional springs in existing installations. There is a further need for an improved counterbalancing system for track-guided doors.

SUMMARY

The present invention is directed to a door mechanism spring assembly that meets these needs. In one embodiment, the spring assembly of the present invention can provide tension between biasing points of the mechanism for counterbalancing the door, and includes a helical compression spring, tension members engaging opposite ends of the spring, at least one of the tension members extending from its point of engagement to beyond the opposite end of the spring, means for connecting the tension members to the biasing points, and means for maintaining axial alignment of the spring with the tension members as the spring is compressed. This embodiment includes limiting means having a movable member for initially preloading the spring at a deflection corresponding to a lowered, closed position of the door for ease of installation.

Preferably one tension member is a rod passing through the spring and the other is a tube enclosing the spring. The spring is thus advantageously restrained within the tube, in case of breakage. Preferably the rod, the spring, and the tube are coaxial and can easily be held in axial alignment during compression of the spring. Preferably the spring is completely enclosed so that even small fragments of the spring are prevented from escaping.

The alignment of the rod, the tube and the spring can be provided by means locating opposite ends of the spring by the rod and the tube, respectively, and providing a first guide on the tube near its pilot for locating the rod, and a second guide on the rod near its pilot, for locating the tube. Preferably the guides are non-metalic for smooth, quite operation with low wear and friction.

Preferably the maximum and minimum deflections of the spring are limited for insuring that the spring is not overloaded and will not fail prematurely from metal fatigue.

Preferably the minimum deflection is limited by a resilient bumper for quiet operation.

In another version of the present invention, a door assembly for a building structure includes a door, a mechanism for guiding the door between an open position and a closed position, a center of mass of the door moving between a raised position and a lowered position when the door is moved between the closed position and the open position, a helical compression spring, tension members engaging opposite ends of the spring, at least one of the tension members extending from its point of engagement to beyond the opposite end of the spring, means for maintaining axial alignment of the spring with the tension members, means for anchoring one of the tension members, and means for connecting the other tension member to the door so that the spring is compressed as the door is moved from the raised position to the lowered position. The connection means can include a rotatably mounted shaft, means for connecting the shaft to the door for rotating the shaft in a first direction when the door is raised and oppositely when the door is closed, and means for connecting the other tension member to the drive shaft for producing the axial compression of the spring by the opposite rotation of the shaft as the door is lowered into the closed position, the tension members causing relative movement of the opposite ends of the spring toward each other. Preferably the assembly includes means for maintaining the spring in a preloaded condition corresponding to the lowered position of the door. This is an important feature that greatly simplifies installation and maintenance of the door assembly. Also, the spring and its preloading means can be located for convenient access at the side of the door, rather than overhead.

Accordingly, the present invention provides a method for counterbalancing a door mechanism between a lowered position and a raised position, the method including the steps of:

1. providing a spring assembly comprising:
   (i) first and second tension members respectively engaging the first and second ends of the spring, the first tension member extending from the first end of the spring to beyond the second end of the spring; and
   (ii) means for maintaining axial alignment of the spring with the tension members;
   (a) temporarily preloading the spring to a predetermined compressed condition;
   (b) connecting the tension members to the mechanism whereby the spring is axially compressed as the door is moved from the raised position to the lowered position as a result of the first and second tension members causing relative movement of the first and second ends of the spring, respectively, toward each other;
   (c) with the door in the lowered position, adjusting the connection of the tension members to the mechanism so that a counterbalancing force between the tension members and the mechanism matches the force produced by the spring in the predetermined compressed condition; and
   (d) releasing the temporary preloading of the spring.

The step of connecting the tension members to the mechanism can include the steps of:

(e) rotatably mounting a shaft to the structure;
(f) fixably mounting a first pulley to the shaft;
(g) connecting a first flexible member between the first pulley and the door so that when the shaft is rotated in a first direction the door is moved toward the raised position and when the door is moved from the raised position to the lowered position the shaft rotates in an opposite direction;
(h) fixably mounting a second pulley to the shaft;
(i) connecting a second flexible member between the second pulley and one of the tension members whereby the spring is axially compressed by movement of the shaft in the opposite direction as the door is moved from the raised position to the lowered position.

The spring assembly of the present invention is safe and reliable in that overloading of the spring and excessive metal fatigue is prevented, and, in the unlikely event of spring failure, the door will not come crashing down and pieces from the spring will not cause injury or property damage.

The spring assembly is inexpensive to make and install in that preloading of the spring can be provided without resorting to special winding techniques, and any desired amount of preloading is possible. Also the spring assembly can directly replace standard extension springs in a conventional pivoted door mechanism.

The spring assembly provides not only a neat, clean appearance but also a high degree of safety in that the spring coils are hidden within the tubular housing, inaccessable to a person's fingers.

DRAWINGS

These and other features, aspects, and advantages of the present invention will become better understood with reference to the following description, appended claims, and accompanying drawings where:

DESCRIPTION

Figure 1:
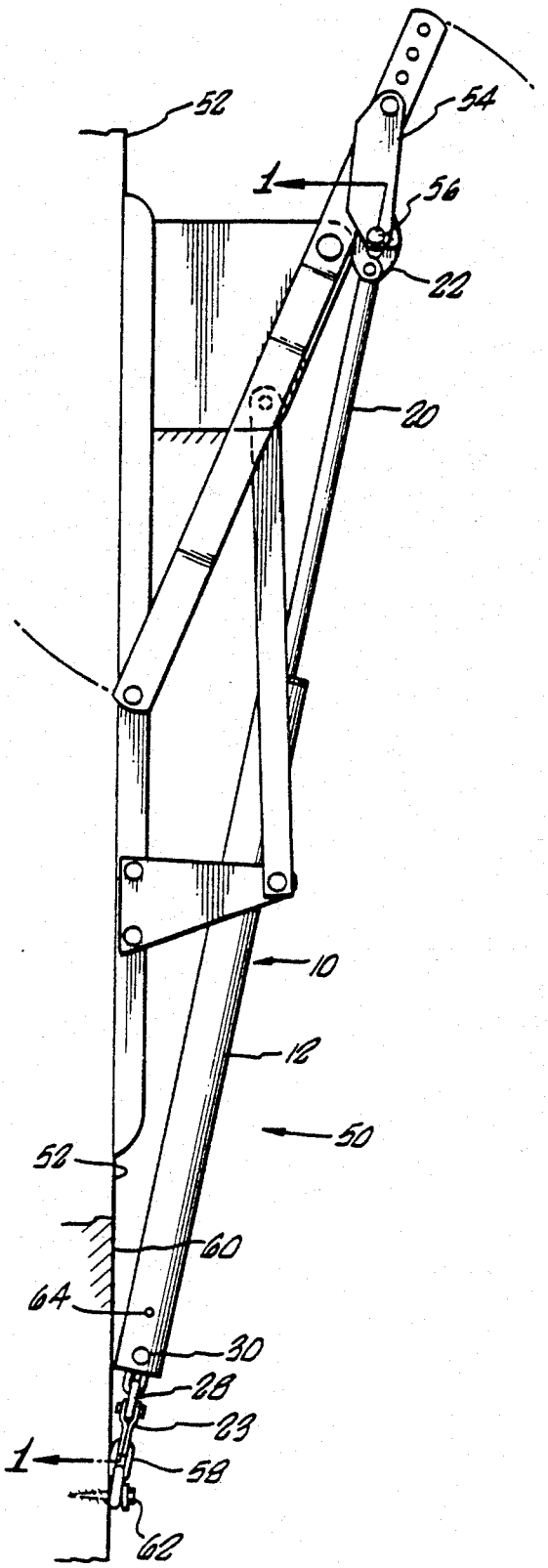
FIG. 1 is a fragmentary longitudinal sectional view of the spring assembly of the present invention, the spring assembly being shown in a retracted, relaxed condition.

With reference to FIG. 1, the present invention is directed to a spring assembly 10 for counterbalancing a door mechanism or the like. The spring assembly 10 comprises an elongate cylindrical tube or housing 12 having an internal flange 14 at one end thereof. The flange 14 can be welded to the housing 12, as shown in the drawings, or formed integrally therewith.

A compression spring 16 is located concentrically within the housing 12, opposite ends thereof being axially retained between the flange 14 and a shoulder nut 18, the shoulder nut 18 engaging a first end 19 of the spring 16, the flange 14 engaging a second end 21 of the spring 16. A rod 20, threadingly engaging the shoulder nut 18 and extending along the axis of the housing through the spring 16 and the flange 14, has a pair of top safety hooks 22, or other connecting means, attached external to the housing 12 for axially coupling a tension force to the rod 20. The safety hooks 22 are fastened to the rod 20 by a clevis bolt 24 and a clevis nut 26.

A coupling chain 28 is connected to the housing 12 at the end opposite the flange 14 by an anchor pin 30 for restraining the housing 12 against the axial tension force transmitted by the rod 26. The anchor pin 30 protrudes through opposite sides of the housing 12 and is retained along its axis by a cotter pin 32. The coupling chain 28 is equipped with a pair of bottom safety hooks 23, also attached with a clevis bolt 24 and a clevis nut 26.

Preferably the coupling chain 28 is confined to a central location along the anchor pin 30 for aligning the chain 28 with the axis of the housing 12 to prevent binding of the rod 26. For this purpose, a pair of pin spacers 34 can be located on the anchor pin within the housing 12 on opposite sides of the coupling chain 28. Alternatively, the pin spacers 34 can be made integral, reinforcing the anchor pin 30.

When tension is applied through the top safety hook 22 to the rod 20, and through the bottom safety hooks 23 to the coupling chain 28, the spring 16 is axially loaded in compression between the flange 14 and the shoulder nut 18. Thus the spring 16 is compressed to the extent that the distance increases between the top safety hooks 22 and the bottom safety hooks 23.

Preferably the spring 16 has a smaller outside diameter than the inside of the housing 12 and is piloted coaxially with the housing for preventing binding, excessive wear, and objectionable noise. Means for piloting the spring 16 can be provided by a piston 36 on the rod 20, the piston 36 being clamped agains the shoulder nut 18 by a piston washer 38 and a piston nut 40. Because the piston 36 is larger in diameter than the spring 16, the shoulder nut 18 and the wiper washer 38, the piston 36 slides in the housing 12, guiding the rod 20 in the housing 12 for maintaining the shoulder nut 18, and the first end 19 of the spring 16 therewith, concentric with the housing 12, thereby preventing binding of the spring 16 against the housing 12.

Additionally, the rod 20 is piloted concentrically with the housing 12 at the flange 14. For this purpose, a grommet or bushing 42 can be installed in the flange 14 for slidingly locating the rod 20, the bushing 42 also locating the second end 21 of the spring 16. Thus the spring 16 is piloted on its inside diameter by the bushing 42 and the shoulder nut 18. If necessary, the center portion of the spring 16, between the flange 14 and the shoulder nut 18, will be guided in contact with the housing 12. In this manner, the housing 12, the spring 16, and the rod 20 are maintained in axial alignment during compression of the spring 16.

Preferably the piston 36 and the bushing 42 are made of non-metallic materials for reducing wear and friction, and providing smooth, quiet operation. For example, both the piston 36 and the bushing 42 can be molded from a plastic such as ABS.

Alternatively, a non-metallic coating or lining 43 can be provided for the housing 12. The wiper disk 36 can then be metallic, integral with the shoulder nut 18 and the wiper washer 38. In this configuration, the advantages of non-metallic sliding contact are extended to the guiding of the center portion of the spring 16.

Preferably a resilient bumper 44 is provided between the rod 20 and the coupling chain 28 for preventing harmful contact therebetween when the spring 16 is released from a compressed state.

Figure 2:
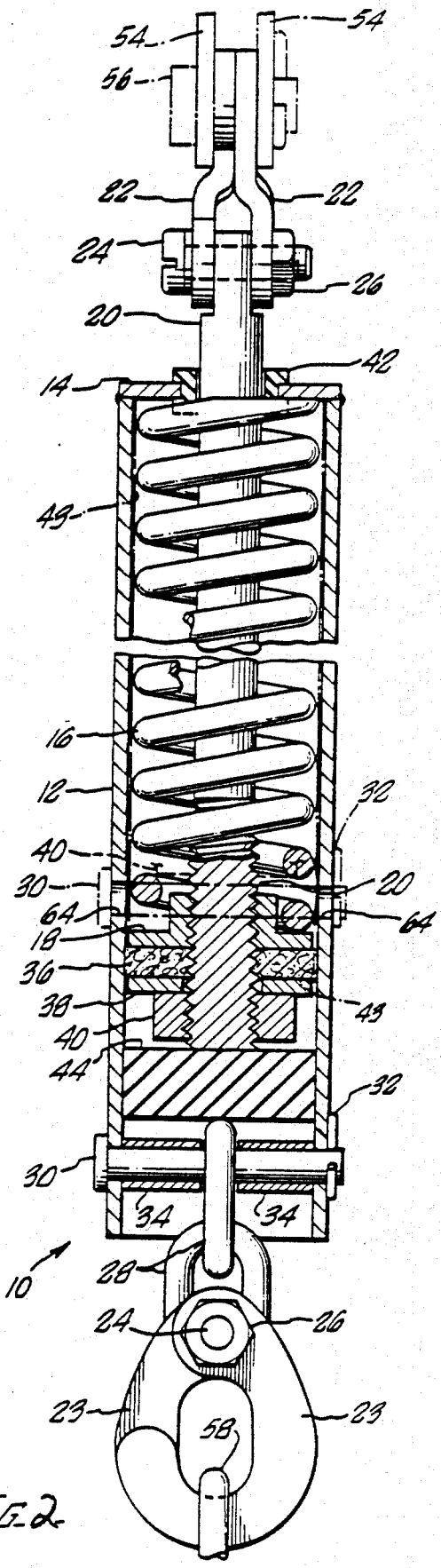
FIG. 2 is a fragmentary side elevational view of a garage door hinge mechanism incorporating the spring assembly of FIG. 1, located along axis 1—1, the mechanism shown in a closed position, the spring assembly being in an extended condition.

With reference to FIG. 2, the spring assembly 10 can be included in a conventional pivoted garage door hinge mechanism 50 for use on a stationary structure 60. The mechanism 50 supports one side of a door 52, shown in a vertical or closed position. A link 54 of the mechanism 50, having a clevis pin 56 therethrough, is coupled by the clevis pin 56 to the top safety hooks 22 of the spring assembly 10 for biasing the door 52 upwardly toward an open position. An anchor chain 58, fastened to the structure 60 by an anchor screw 62, is connected to the bottom safety hooks 23 for axially restraining the housing 12. The clevis pin 56 and the anchor screw 62 function as biasing or connection points of the mechanism 50, these points moving apart as the door 52 is lowered from the open position to the closed position.

Figure 3:
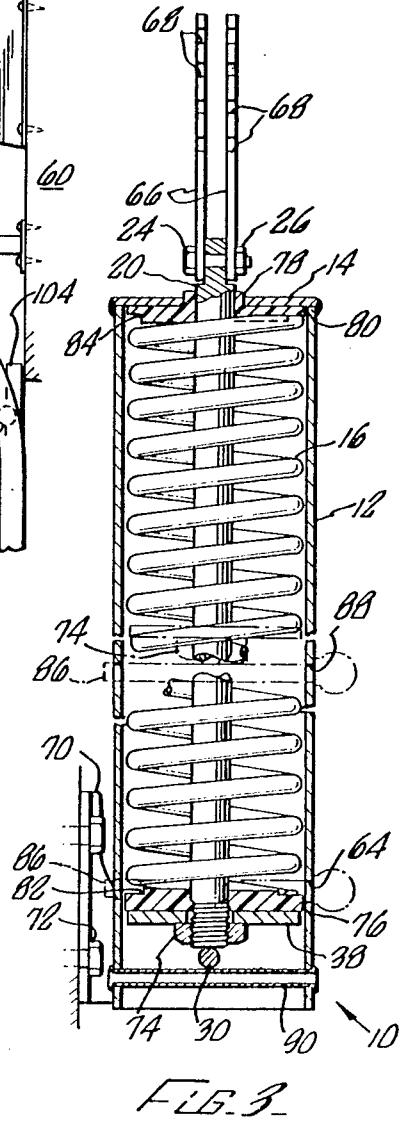
FIG. 3 is a fragmentary view showing a preferred alternative configuration of the spring assembly of FIG. 1.
Figure 6:
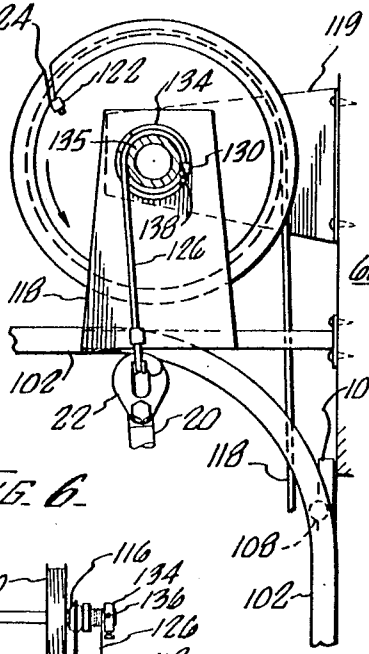
FIG. 6 is a fragmentary sectional elevational view of the mechanism of FIG. 4 on line 6—6 in FIG. 5.
Figure 5:
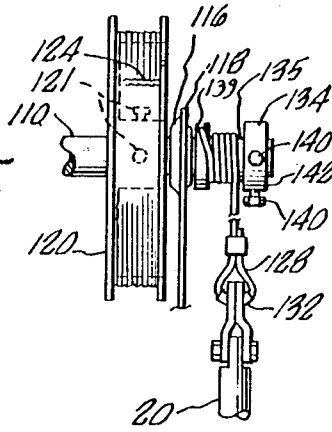
FIG. 5 is a fragmentary detail view of the mechanism of FIG. 4 within region 5 in FIG. 4.

An alternative configuration of the present invention is shown in FIG. 3, with like designations indicating corresponding parts of the above description. For coupling the tension force to the rod 20, a pair of strap members 66 are fastened thereto by the clevis bolt 24, the strap members 66 being capable of replacing the link 54 of the mechanism 50. The strap members 66 are perforated with a plurality of adjustment holes 68 for selective attachment to the remainder of the mechanism 50. An anchor bracket 70 is pivotably connected to the housing 12, the anchor bracket 70 being adapted for mounting to the stationary structural member 60 by a plurality of anchor screws 72.

The first end 19 of the spring 16 is coupled to the rod 20 by a lock nut 74 and piloted concentrically with the housing 12 by a piston 76, the piston 76 being reinforced by the piston washer 38. Also, a bushing 78 protrudes the flange 14 for guiding the rod 20, the bushing 78 having a flanged portion 80 extending between the flange 14 and the second end 21 of the spring 16 for retaining the bushing 78 in engagement with the flange 14.

The piston 76 and the bushing 78 are preferably made from a non-metallic, dimensionally stable material having low friction and wear characteristics, such as an acetyl resin. The piston 76 and the bushing 78 can have respective lands 82 and 84 for piloting the corresponding ends 19 and 21 of the spring 16 coaxially within the housing 12.

Installation of the spring assembly 10 into the mechanism 50 is preferably facilitated by temporarily preloading the spring 16 to an intermediate position, thereby extending the rod 20 and moving apart the safety hooks 22 and 23 (or, in the configuration shown in FIG. 3, the strap members 66 and the anchor bracket 70) relative to each other. For this purpose, a pair of first preload holes 64 are provided in the housing 12 for a moveable member or preload pin 86 (which can be a duplicate of the anchor pin 30), and associated cotter pin 32, the preload pin 86 holding the rod 20 in the partially extended position. Thus, the spring assembly 10 can be easily connected to the mechanism 50 with no tension applied between this clevis pin 56 and the anchor screw 62 when the door 52 is in a raised, or partially raised position. The door 52 can then be lowered, separating the rod 20 from the preload pin 86, so that the pin can easily be removed, completing the installation.

More preferably, the housing 12 has a pair of second preload holes 88 as shown in FIG. 3 for receiving the preload pin 86 when the spring assembly 10 is fully extended. This is an important feature of the present invention that permits the spring assembly 10 to be installed with the door 52 in the closed position. Further, when the spring assembly 10 is equipped with an adjustable anchor bracket, further described below, adjustment of the operating preload of the spring 16 can be accomplished with the door 52 closed, and the anchor bracket in an unloaded condition. An anti-tamper rivet 90 protrudes opposite sides of the housing 12 below the anchor pin 30 for preventing unauthorized disassembly of the spring assembly 10.

Another important feature of the present invention is that compressive deformation of the spring 16 can be no greater than that causing contact between the adjacent coils of the spring. Thus torsional and shear loading of the coils are limited by this "solid height condition" of the spring.

Preferably the spring 16 is wound such that compression to the solid height does not result in overloading of the spring. Thus the reliability of the spring assembly 10 is improved over conventional tension springs that are subject to overloading and consequent failure when they are extended beyond a rated length.

Another feature of the present invention is that for a given coil diameter and wire size, the spring 16, being compressively loaded, can carry a greater load than a tension spring, due to the way that the axial and torsional coil stresses interact. Thus for a given load carrying capacity, the spring 16 can be made smaller and lighter than conventional extension springs.

Another feature of the present invention is that in the unlikely event of a spring failure, the load is carried by adjacent coils in contact, precluding complete failure of the spring assembly 10. Thus the door can not come crashing down on a person attempting to operate the door when the failure occurred. Neither would the end portions whip around because they are restrained by the housing 12 and/or the rod 20. Instead, the door would remain operable, with slightly reduced counterbalancing.

Preferably the spring 16 is completely enclosed by the housing 12 for preventing broken fragments from escaping in case of spring failure. The housing 12 provides the further advantages of preventing objects from being caught between coils of the spring 16 and providing a neat, clean appearance of the spring assembly 10.

Preferably the bumper 14 limits the travel of the rod 20 in the direction of unloading the spring 16, effecting a preloading of the spring 16. The preloading is adjustable according to the position of the shoulder nut 18 and the wiper nut 40 on the rod 20. This preloading, in contrast with conventional tension springs, is only limited by the design of the spring 16 and the length of the housing 12. Thus the spring assembly 10 can be assembled with a desired preload before it is incorporated in the door mechanism 50, reducing the work required to complete the installation. Tension springs on the other hand, can be only slightly preloaded by introducing twist during winding, and the preloading is adjustable only to the extent that the door mechanism 50 is adjusted to prevent coil-to-coil contact.

A further advantage of the bumper 44 is that the fatigue life of the spring can be controlled by the preloading described above, because the maximum coil loading is limited by the solid height condition as also described above. This is because the fatigue life is a function of both maximum and minimum cyclic stress levels, both being controlled in the present invention. Thus a high minimum fatigue life can now be provided, a life that can only be extended, not reduced, by subsequent adjustment of the door mechanism 50 external to the spring assembly 10. In the configuration shown in FIG. 3, the anchor pin 30 functions as the bumper in that the operating travel of the rod 20 in the direction of spring extension is limited by contact with the anchor pin 30. Even if the anchor pin 30 is inadvertently removed from the spring assembly 30 without the preload pin 86 being in place, the anti-tamper rivet 90 will still limit the maximum spring extension.

Moreover, the resilience of the bumper 44 advantageously provides gradual unloading of the spring 16 as the rod 20 comes into contact with the bumper 44. Thus the full range of travel of the rod 20 within the housing 12 can be used without noisy or jerky operation of the door mechanism 50.

Another important feature of the present invention is that the spring assembly 10 can directly replace the ordinary tension springs of the pivoted door mechanism 50. An inspection of many popular garage door hinge mechanisms revealed that the maximum spring travel required between open and closed door positions is about 17.5 inches. In practice, the spring assembly 10 can be configured as the functional equivalent of popular tension spring designs by adjusting the length of the anchor chain 58 and the preloading of the spring 12, facilitating replacement of the tension springs in existing door mechanisms.

The spring assembly 10 of the present invention can be made in a number of load capacities, for counterbalancing a variety of loads. With reference to Table 1, relating to the configuration of FIG. 3, four exemplary models of the spring assembly are given. Each of the models is identified by its respective load capacity, namely 480, 360, 240 and 120 pounds, each being suitable for a particular load range. For example, the 480 lb. capacity is recommended for double-width wooden garage doors that weigh from about 190 lb, to about 205 lb. The 360 lb. capacity is recommended for lightweight double doors and overweight single-width garage doors. The 240 lb. capacity is for regular wood and steel single doors. The 120 lb. capacity is for lightweight aluminum single-width doors.

TABLE 1

| Spring Assembly Parameters | | | | |
|---|---|---|---|---|
| | Configuration | | | |
| Element | A | B | C | D |
| Spring - Coils | 83.1 | 73.6 | 76.3 | 82.0 |
| Wire Dia. | 0.283 | 0.243 | 0.218 | 0.190 |
| Outside Dia. | 2.095 | 1.937 | 1.875 | 1.875 |
| Length - Free | 52.0 | 44.5 | 43.0 | 43.0 |
| After Set | 50.5 | 43.0 | 41.7 | 43.0 |
| Solid | 23.52 | 17.88 | 16.63 | 15.77 |
| Rate | 19.1 | 14.4 | 9.6 | 4.8 |
| Housing - O.D. | 2.250 | 2.125 | 2.125 | 2.125 |
| Length | 42.5 | 37.0 | 37.0 | 37.0 |
| Travel | 16.5 | 16.62 | 17.9 | 18.73 |
| Retract. Length | 46.5 | 39.0 | 39.0 | 39.0 |
| Load Capacity | | | | |
| Coil to Coil | 512 | 383 | 255 | 130 |
| 15" Extension | 480 | 360 | 240 | 120 |
| Min. Preload | 193 | 144 | 96 | 48 |

With reference to FIGS. 4–8, the present invention provides a particularly advantageous counterbalanced track-guided door apparatus 100. The door apparatus 100 includes oppositely disposed C-section track members 102 that are adapted to be affixed on the stationary structure 60. A door 104, having a plurality of articulated segments 106 for permitting the door 104 to follow a curved path of the track member 102, is guided between a lowered, closed position, and a raised open position by a plurality of followers 108 that engage the track members 102.

A transverse, rotatably mounted drive shaft 110 connects opposite sides of the door 104 by means of a pair of lift cables 112, corresponding attachment means 114 for the lift cables 112 being provided proximate the bottom of the door 104. Each end of the drive shaft 110 is rotatably supported by a shaft bearing 116 that is fastened to a gusset member 118, the drive shaft 110 protruding the gusset member 118, the gusset member 118 being rigidly fastened to a respective track member 102 of the door apparatus 100. When the distance between the ends of the drive shaft 110 is great, such as in FIG. 4 that shows a double-width garage door (about 7 feet high by about 16 feet wide), an additional bearing 116 and an associated gusset member 119 prevents excessive sag an vibration of the driveshaft 110, the gusset member 119 being mounted to the structure 60 above the door 104 in the closed position, about midway between the gusset members 118.

Each of the lift cables 112 is wound onto a lift pulley 120 that is rigidly attached to the drive shaft 110 by clamp means 121 at a location immediately inboard of the respective gusset 118, each cable 112 being anchored to its pulley 120 by a bead member 122 thereof that engages a slot 124 in the respective pulley 120. Thus, when the drive shaft 110 is rotated in a first direction, designated by the arrow in FIG. 6, the door 104 is raised toward the open position by the lift cable 112.

According to the present invention, the spring assembly 10 is anchored to the stationary structure 60 and coupled to the drive shaft 110 for counterbalancing the door 104 as described herein. A power cable 126, having an eye 128 at one end thereof and a bead member 130 at the opposite end, is connected to the rod 20 by the top safety hooks 22, the top safety hooks 22 engaging the eye 128. A sleeve 132 covers the cable 126 within the eye 128 for protection of the cable 126 against damage by the safety hooks 22.

A power pulley 134, rigidly attached to the drive shaft 110 outboard of the shaft bearing 116 by clamp means 136, has the power cable 126 wound onto a drum portion 135 thereof for applying a counterbalancing torque to the drive shaft 110, the bead member 130 of the cable 126 engaging a cavity 138 of the power pulley 134 for preventing slippage of the cable 126 therefrom. Because the drum portion 135 of the pulley 134 has a root diameter that is only slightly larger than the diameter of the driveshaft 110, the cavity 138 is located in a flange 137, to one side of the drum portion 135. A slot 139 extends from the cavity 138, through a portion of the flange 137, leading onto the drum portion 135 for providing a smooth transition of the cable 126 from the cavity onto the drum portion 135. The clamp means 136 can be a pair of set screws 140 threadingly protruding a second flange 142 of the power pulley 134 and bearing against the driveshaft 110.

Figure 4:
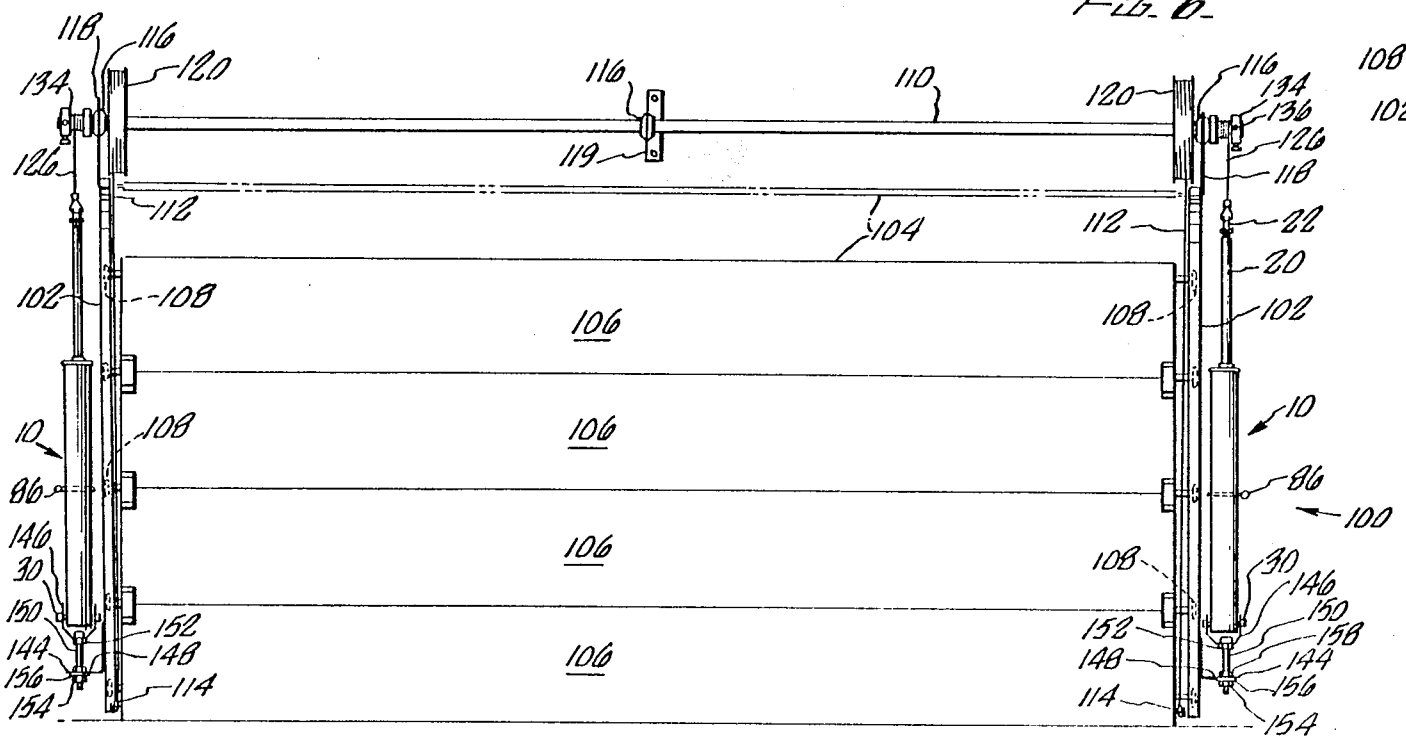
FIG. 4 is a rear elevational view of a garage door guide mechanism incorporating the spring assembly of FIG. 1.

As shown in FIG. 4, the spring assembly 10 is anchored to the track member 102 by an adjustable bracket 144 rather than the previously described anchor chain 58 of FIG. 2 or the anchor bracket 70 of FIG. 3, for more conveniently adjusting the preload of the spring 16. The adjustable bracket 144 includes a U-shaped member 146 that is connected at opposite ends thereof to the housing 12 by the anchor pin 30, an L-shaped member 148 for mounting to the track member 102, and a threaded stud 150 that is rigidly connected to the U-shaped member 146, extending downwardly therefrom and protruding the L-shaped member 148. The stud 150 can be a cap screw that is clamped to the U-shaped member 146 by a nut 152. The stud 150 is adjustably attached to the L-shaped member by a lock nut 154 and a washer 156 under the L-shaped member. Also, a jamb nut 158 can be used against the top of the L-shaped member 148 for locking the adjustable bracket 144.

The present invention advantageously allows the door apparatus 100 to be quickly, easily and safely assembled and adjusted as described herein. The track members 102 are fastened to the structure, and the door 104, including the segments 106 and its followers 108 are installed therein in a conventional manner with the door 104 in the closed position. The driveshaft 110 is mounted to the track members 102 on the bearings 116 by the gusset members 118 (and 119, if necessary), with the lift pulleys 120 located immediately inboard of the bearings 116. One of the lift cables 112 is next connected to the attachment means 114 and brought upwardly to the respective lift pulley 120, with the bead member 122 engaging the respective slot 124 thereof. With the pulley 120 clamped to the driveshaft 110 by the clamp means 121, the combination is rotated on the bearings 116, thereby wrapping the cable 112 around the pulley 120 in a direction toward the door 104 from the tops of the pulley 120. A sufficient length of the cable 112 is used to obtain a circumferential contact about the lift pulley 120 in excess of the travel of the door 104 when the cable is tight. In this condition, the driveshaft is next temporarily clamped from rotation by suitable means such as vice pliers (not shown), and the opposite cable 112 is strung in the same manner, but with rotation of the opposite lift pulley 120 on the driveshaft 110 for wrapping the cable 112 thereon. With both of the cables 112 tight, the opposite pulley 120 is also clamped to the driveshaft 110 by its clamp means 121.

With the lift cables 112 in place, the power pulleys 134 are installed on the driveshaft 110, outboard of the bearings 116, then the power cables 126 are attached thereto by engaging the bead members 130 thereof in the respective cavities 138 of the power pulleys 134. Next, the power cables 126 are wound through the slot 139 and onto the respective drum portions 135 in a direction opposite the wrap of the lift cables 112 on the lift pulleys 120, away from the door 104 at the tops of the power pulleys 134, the cables 126 being temporarily secured to the pulleys 134 by adhesive tape or the like. The L-shaped members 148 of the adjustable brackets 144 are next fastened to the track members 102, being located vertically at an appropriate height for connecting to the cables 126 in a tightened condition by the spring assemlbies 10 when the brackets 144 are adjusted to an intermediate position.

The rod 20 of each spring assembly 10, with the U-shaped member 146 and stud 150 attached, is connected to the eye 128 of the respective power cable 126, the stud is extended through the L-shaped member 148, and the lock nut 154 is installed. An initial adjustment of the bracket 144 is obtained by simply tightening the lock nut 144 until the preload pin 186 is released from the second preload holes 88. Initially there is no load on the stud 150. Then, as the cable becomes tight, there is increasing load on the lock nut 154, but there is no compression of the spring 16 beyond the initial preload until the preload pin 86 is released. This contributes to the safety of the adjustment process because there is no energy being stored in the spring 16 until the initial adjustment is completed. Thus, even though the adjustment is made with the spring 16 fully compressed, structural failure of any load-carrying member during the initial adjustment does not result in a massive release of stored energy from the spring. Thus the dangers that are presented by conventional torsion springs in overhead door mechanisms are avoided by the present invention, and there is no need for the special license that is often required for the installation and adjustment of torsion springs.

When the spring assembly 10 is used in the door assembly 100, a reduced minimum preload is typically desired because the door 104 moves predominately horizontally on the track members 102, requiring less counterbalancing force proximate the raised position than the pivoted doors. Accordingly, the configuration of the spring assembly 10 can be modified by reducing the number of coils of the spring 16, as shown in Table 2, relating to the exemplary configuration "A" of Table 1.

TABLE 2

| Guided Door Spring Parameters | | | | |
|---|---|---|---|---|
| | Configuration | | | |
| Element | A1 | A2 | A3 | A4 |
| Spring - Coils | 73.1 | 74.8 | 76.4 | 78.1 |
| Length | 42.5 | 43.5 | 44.5 | 45.5 |
| Travel | 19.3 | 18.8 | 18.4 | 17.9 |
| Load Capacity | | | | |
| 15" Extension | 346 | 352 | 358 | 364 |
| Min. Preload | 49.5 | 66.7 | 82.7 | 97.5 |

A pair of spring assemblies 10 in the configuration "A1" has been used successfully for counterbalancing a door 104 of steel construction, measuring seven feet high by 16 feet wide (double-width), having four of the segments 106, the door 104 weighing about 195 lb., the curved portion of the track members 102 having a 15 in. radius. In this example, the lift pulleys measured 6.5 inches in diameter, and the drum portion 135 of the power pulleys measured 1.3 inches in diameter. Thus, for seven feet of travel between the raised and lowered positions, the driveshaft made about 4 revolutions, and the required travel of the spring 16 was about 18 inches, allowing 0.125 in. for the diameter of both the lift cable 112 and the power cable 126, which can have a conventional 7×14 strand configuration. The door 104 in this example was so well counterbalanced according to the present invention that only 22.5 lb. was required to lift it from the lowered position. This is a significant improvement below many conventional doors that require a lifting force of up to about 20% of the weight of the door, 39 lb. in this example. This configuration has also been used with the door 104 having 5 of the segments 106, the track members 102 having 12 in. radius, with similar results.

The configuration "A1" can also be used as described above when the door 104 is reduced from double-width to single width (8 ft.) by deleting one of the spring assemblies 10, power cables 126, and power pulleys 134. The driveshaft 110, operating in combination with the lift cables 112, advantageously keeps the opposite sides of the door 104 in alignment, whether one or both of the spring assemblies is connected.

Although the present invention has been described in considerable detail with regard to certain versions thereof, other versions are possible. For example, the rod 20 can be connected to the driveshaft 110 by a pinion on the driveshaft engaging a rack member on the rod 20. Also, the door can be inverted so that the open position is the lowered position and the closed position is the raised position. Further, the diameters of the lift pulley 120 and the power pulley 134 can be scaled down by locating the drum portion 135 outboard of the driveshaft 110. Thus the drum portion 135 can be made smaller than the diameter of the driveshaft 110 as long as the power cable 126 provides sufficient flexibility. For this purpose, the cable 126 can have a 7×19 configuration of lead-plated steel wire, impregnated and covered with nylon for lubrication and protection. Therefore, the spirit and scope of the appended claims should not necessarily be limited to the description of the versions contained herein.

What is claimed is:

1. A spring assembly for counterbalancing a door mechanism having a pair of biasing connection points moving apart relative to each other as the door is lowered into a closed position, the assembly comprising:

(a) a helical compression spring having a first end and a second end;

(b) first and second tension members respectively engaging the first and second ends of the spring, the first tension member extending from the first end of the spring to beyond the second end of the spring;

(c) means for maintaining axial alignment of the spring with the tension members;

(d) means for connecting the tension members to the connection points of the door mechanism;

wherein the installed spring is axially compressed as the door is lowered into the closed position; and (e) means for limiting the minimum deflection of the spring, comprising a moveable member slideable into and out of said means for maintaining axial alignment, the member being located for producing an initial preload of the spring prior to engagement of the connecting means, the initial preload producing a maximum compression slideable into and out of said means for maintaining axial alignment deflection of the spring corresponding to the closed position of the door.

2. The spring assembly of claim 1 wherein the first tension member comprises a rod passing through the spring and the second tension member comprises a tube surrounding the spring.

3. The spring assembly of claim 2 wherein the rod, the spring, and the tube are coaxial.

4. The spring assembly of claim 2 wherein the spring is completely enclosed.

5. The spring assembly of claim 2 wherein the means for aligning comprises:

(a) means on the first tension member for locating the first end of the spring;

(b) means on the second tension member for locating the second end of the spring;

(c) an internal flange on the second tension member located proximate to the second end of the spring, the internal flange slidingly locating the first tension member; and (d) an external flange on the first tension member proximate to the first end of the spring, the external flange slidingly locating the second tension member.

6. The spring assembly of claim 4 wherein the internal flange comprises a first non-metallic guide for the first tension member and the external flange comprises a second non-metallic guide for the second tension member for smooth operation.

7. The spring assembly of claim 5 wherein the internal flange comprises a first non-metallic guide for the first tension member and the second tension member comprises a second non-metallic guide for the external flange.

8. The spring assembly of claim 1 wherein the means for limiting comprises coil-to-coil contact of the spring limiting the maximum deflection, and bumper means for preventing relative axial movement between the first tension member and the second tension member beyond a position corresponding to a predetermined minimum compressive deflection of the spring.

9. A counter-balanced door assembly for a building structure, the assembly comprising:

(a) a helical compression spring having a first end and a second end;

(b) first and second tension members, both tension members having a spring engagement end and an opposed connection end, the spring engagement end of the first tension member engaging the first end of the spring, the first tension member extending from the first end of the spring toward the second end of the spring, the spring engagement end of the second tension member engaging the second end of the spring;

(c) means for maintaining axial alignment of the spring with the tension members;

(d) a door, the door having a center of mass;

(e) means for guiding the door from a closed position to an open position, the center of mass of the door moving between a raised position and a lowered position when the door is moved between the closed position and the open position;

(f) means for anchoring one of the connection ends of the tension members; and (g) means for connecting the other connection end to the door, comprising:

(i) a rotatably mounted shaft;

(ii) lift means for connecting the shaft to the door so that when the shaft is rotated in a first direction the door is moved toward the raised position, and when the door is moved toward the lowered position the shaft is rotated in an opposite direction; and (iii) drive means for connecting the other of the connection ends to the shaft such that when the door is moved toward the lowered position, the opposite direction of rotation of the shaft produces the axial compression of the spring, whereby the spring is axially compressed as the door is moved from the raised position to the closed position as a result of the first and second tension members causing relative movement of the first and second ends of the spring, respectively, toward each other.

10. The door assembly of claim 9 wherein the guiding means comprises a track member for attaching to the building and follower means attached to the door, the follower means moveably engaging the track means for locating the door in a predetermined path between the open position and the closed position.

11. The door assembly of claim 10 wherein at least a portion of the track member is curved, the door comprising a plurality of moveably connected elements, at least some of the elements being serially guided along the curved portion of the track member by the follower means as the door is moved between the open and closed positions.

12. The door assembly of claim 9 further comprising means for limiting the deflection of the spring.

13. The door assembly of claim 12 wherein the limiting means comprises a moveable member, the moveable member being located for producing an initial preload of the spring prior to engagement of the connecting means, the initial preload being produced at a maximum compression deflection of the spring corresponding to the closed position of the door.

14. The door assembly of claim 9 wherein the drive means is connected to the first tension member and the anchor means is connected to the second tension member.

15. The door assembly of claim 14 wherein the first tension member comprises a rod passing through the spring and the second tension member comprises a tube surrounding the spring.

16. The door assembly of claim 15 comprising means for limiting relative axial movement between the rod and the tube for preloading the spring in compression.

17. The door assembly of claim 16 including adjustment means for adjusting the position of the limiting means for adjusting the minimum compressive deflection of the spring.

18. The door assembly of claim 17 wherein the adjustment means is incorporated in the anchor means, and the limiting means includes a pin member removably mounted in the tube, the pin member preventing axial movement of the rod in the tube for providing an initial preload of the spring prior to engagement of the connecting means.

19. The door assembly of claim 18 wherein the pin member is located for producing the initial preload at a maximum compressive deflection of the spring corresponding to the lowered position of the door.

20. A counter-balanced door assembly for a building structure, the assembly comprising:

(a) a helical compression spring having a first end and a second end;

(b) first and second tension members, both tension members having a spring engagement end and an opposed connection end, the spring engagement end of the first tension member engaging the first end of the spring, the first tension member extending from the first end of the spring toward the second end of the spring, the spring engagement end of the second tension member engaging the second end of the spring, the first tension member comprising a rod passing through the spring, the second tension member comprising a tube surrounding the spring;

(c) means for maintaining axial alignment of the spring with the tension members;

(d) a door, the door comprising a plurality of moveably connected elements and having a center of mass;

(e) means for guiding the door from a closed position to an open position, the center of mass of the door moving between a raised position and a lowered position when the door is moved between the closed position and the open position, the guiding means comprising a track member for attaching to the building and follower means attached to the door, the follower means moveably engaging the track means for locating the door in a predetermined path between the open position and the closed position, at least a portion of the track member being curved, at least some of the elements of the door being serially guided along the curved portion of the track member by the follower means as the door is moved between the open and closed positions;

(f) means for limiting relative axial movement between the rod and the tube for preloading the spring in compression;

(g) means for anchoring the connection end of the second tension member;

(H) means for connecting the connection end of the first tension member to the door, comprising:

(i) a rotatably mounted shaft;

(ii) lift means for connecting the shaft to the door so that when the shaft is rotated in a first direction the door is moved toward the raised position, and when the door is moved toward the lowered position the shaft is rotated in an opposite direction;

(iii) drive means for connecting the other of the connection ends to the shaft such that when the door is moved toward the lowered position, the opposite direction of rotation of the shaft produces axial compression of the spring as a result of the first and second tension members causing relative movement of the first and second ends of the spring, respectively, toward each other.

21. A method for counterbalancing a door mechanism of a building structure, the mechanism permitting the door to be moved between a lowered position and a raised position, the method comprising the steps of:

(a) providing a spring assembly comprising:

(i) first and second tension members respectively engaging the first and second ends of the spring, the first tension member extending from the first end of the spring to beyond the second end of the spring; and (ii) means for maintaining axial alignment of the spring with the tension members;

(b) temporarily preloading the spring to a predetermined compressed condition;

(c) connecting the tension members to the mechanism whereby the spring is axially compressed as the door is moved from the raised position to the lowered position as a result of the first and second tension members causing relative movement of the first and second ends of the spring, respectively, toward each other;

(d) with the door in the lowered position, adjusting the connection of the tension members to the mechanism so that a counterbalancing force between the tension members and the mechanism matches the force produced by the spring in the predetermined compressed condition; and (e) releasing the temporary preloading of the spring.

22. The method of claim 21 wherein the step of connecting the tension members to the mechanism comprises the steps of:

(a) rotatably mounting a shaft to the structure;

(b) fixably mounting a first pulley to the shaft;

(c) connecting a first flexible member between the first pulley and the door so that when the shaft is rotated in a first direction the door is moved toward the raised position and when the door is moved from the raised position to the lowered position the shaft rotates in an opposite direction;

(d) fixably mounting a second pulley to the shaft;

(e) connecting a second flexible member between the second pulley and one of the tension members whereby the spring is axially compressed by movement of the shaft in the opposite direction as the door is moved from the raised position to the lowered position.

* * * * *